US011071988B2

(12) United States Patent
Farquhar et al.

(10) Patent No.: US 11,071,988 B2
(45) Date of Patent: Jul. 27, 2021

(54) ROTATABLE MAGNET CRADLE FOR SWARF SEPARATION

(71) Applicant: Halliburton Energy Services, Inc., Houston, TX (US)

(72) Inventors: Michael J. Farquhar, Aberdeenshire (GB); Derek Mackay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/592,700

(22) Filed: Oct. 3, 2019

(65) Prior Publication Data

US 2020/0215550 A1 Jul. 9, 2020

Related U.S. Application Data

(60) Provisional application No. 62/789,914, filed on Jan. 8, 2019.

(51) Int. Cl.

| | |
|---|---|
| ***B03C 1/06*** | (2006.01) |
| ***E21B 21/06*** | (2006.01) |
| ***B03C 1/28*** | (2006.01) |

(52) U.S. Cl.

CPC ..... *B03C 1/284* (2013.01); *B03C 1/06* (2013.01); *B03C 2201/18* (2013.01); *B03C 2201/20* (2013.01); *B03C 2201/28* (2013.01); *E21B 21/065* (2013.01)

(58) Field of Classification Search

CPC ..... B03C 1/06; B03C 1/284; B03C 2201/18; B03C 2201/20; E21B 21/065

See application file for complete search history.

(56) References Cited

U.S. PATENT DOCUMENTS

| | | | | |
|---|---|---|---|---|
| 4,457,838 | A * | 7/1984 | Carr | B03C 1/284 209/223.2 |
| 6,902,066 | B2 | 6/2005 | Yang | |
| 2009/0218145 | A1 | 9/2009 | Branch | |

(Continued)

FOREIGN PATENT DOCUMENTS

| | | | |
|---|---|---|---|
| WO | 2018172843 | A1 | 9/2018 |

OTHER PUBLICATIONS

International Search Report and Written Opinion issued in related PCT application No. PCT/US2019/054830, dated Feb. 7, 2020, 12 pages.

(Continued)

*Primary Examiner* — Bradley R Spies

(74) *Attorney, Agent, or Firm* — Tenley Krueger; Baker Botts L.L.P.

(57) ABSTRACT

A rotatable magnet cradle assembly that can be used to separate swarf from a flow of fluid is provided. The cradle of magnets can be rotated a certain amount about a rotational axis from an operational position to a cleaning position. The magnet cradle may include a tube extending between two brackets, a shaft to which the two brackets are attached, and a magnet bar extending through the tube. In the operational position, the magnet provides a magnetic field that attracts swarf to an outer surface of the tube. Once it is desired to clean the assembly, the shaft is rotated to move the two brackets and tube out of the fluid flow and to a position proximate a discharge location, where the magnet bar can be removed from the tube to release the swarf.

20 Claims, 10 Drawing Sheets

(56) References Cited

U.S. PATENT DOCUMENTS

| | | | | |
|---|---|---|---|---|
| 2011/0186523 | A1 | 8/2011 | Williamson et al. | |
| 2011/0203976 | A1* | 8/2011 | Baker | B03C 1/0332 209/214 |
| 2015/0159448 | A1 | 6/2015 | White | |
| 2015/0176352 | A1* | 6/2015 | McKenzie | B03C 1/286 210/695 |

OTHER PUBLICATIONS

EZ-Clean magnets by Romar: http://www.romarinternational.co.uk/ditch-magnets/ez-clean/; accessed on Oct. 3, 2019.

* cited by examiner

ROTATABLE MAGNET CRADLE FOR SWARF SEPARATION

CROSS REFERENCE TO RELATED APPLICATION

The present application claims priority to U.S. provisional application Ser. No. 62/789,914, entitled "ROTATABLE MAGNET CRADLE FOR SWARF SEPARATION," filed on Jan. 8, 2019.

BACKGROUND

The present disclosure relates generally to magnetic separators and, more particularly, to a rotatable magnet cradle used for swarf separation.

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation. After drilling a wellbore that intersects a subterranean hydrocarbon-bearing formation, a variety of wellbore tools may be positioned in the wellbore during completion, production, or remedial activities. It is common practice in completing oil and gas wells to set a string of pipe, known as casing, in the well and use a cement sheath around the outside of the casing to isolate the various formations penetrated by the well.

At times, slot recovery and/or decommissioning operations may be performed on an oil and gas well. These operations often require the removal of sections of the original casing, e.g., via extensive milling operations. Such milling operations generate significant quantities of swarf (metallic shavings, filing, and particulates). Section and window milling operations used to sidetrack wells also generate large quantities of swarf. Removal of swarf from a milling fluid requires a reliable and efficient means of separation at the surface to ensure successful operations. If the harsh metallic materials are not removed, this can lead to excessive wear and tear on rig surface equipment and contamination of drilling fluids. Improvements in separation and recovery units used to separate swarf from a flow of fluid are desired.

BRIEF DESCRIPTION OF THE DRAWINGS

These drawings illustrate certain aspects of some of the embodiments of the present disclosure, and should not be used to limit or define the claims.

Figure 1A:
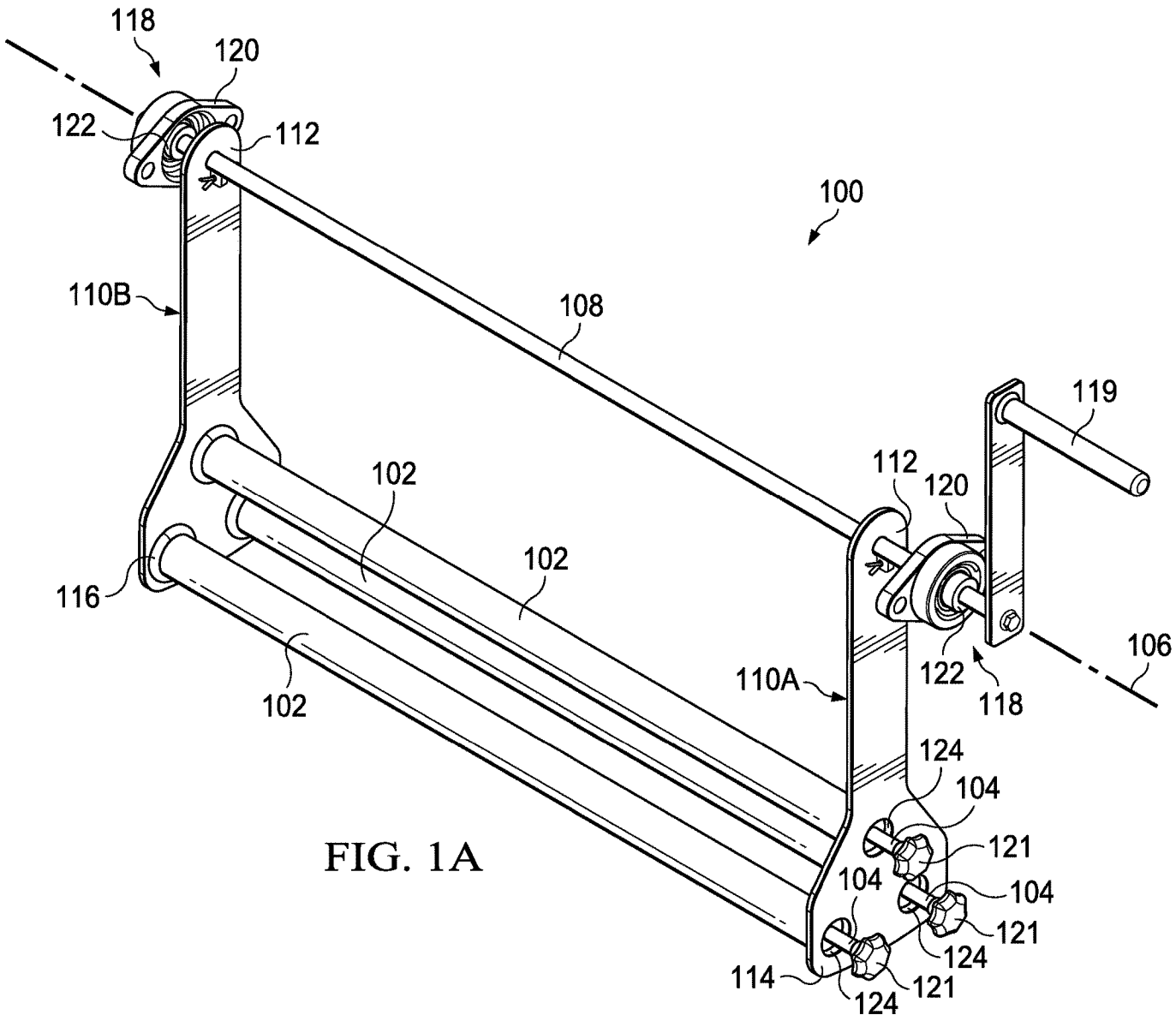
FIGS. 1A and 1B are elevation views of a rotatable magnet cradle assembly, in accordance with an embodiment of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF CERTAIN EMBODIMENTS

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection or monitoring wells as well as production wells, including hydrocarbon wells. Embodiments may be implemented using a tool that is made suitable for separating swarf from an incoming fluid flow at a surface location proximate a well.

The terms "couple" or "couples" as used herein are intended to mean either an indirect or a direct connection. Thus, if a first device couples to a second device, that connection may be through a direct connection, or through an indirect mechanical, electromagnetic, or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections. Finally, the term "fluidically coupled" as used herein is intended to mean that there is either a direct or an indirect fluid flow path between two components.

The present disclosure is directed to a rotatable magnet cradle assembly that can be used to separate swarf (i.e., ferrous material) from a flow of fluid. For example, the disclosed rotatable magnet assembly may be used to remove swarf (for example, metallic shavings, filing, particulates, and combinations thereof) from one or more fluids used in milling a well (e.g., a hydrocarbon well, a water well, or some other type of well). The cradle of magnets can be rotated a certain amount (e.g., 270 degrees) about a rotational axis from an operational position to a cleaning position. Rotation of the magnets from a fluid path to a discharge chute via the cradle assembly provides a simple and effective way to clean the magnets, which is not currently available with existing systems. The disclosed magnet cradle assembly is a simple and effective system that may be utilized in swarf recovery in fluid paths in various locations or as a stand-alone device.

Turning now to the drawings, FIG. 1 illustrates a magnet cradle assembly 100 in accordance with an embodiment of the present disclosure. The magnet cradle assembly 100 includes at least one elongated tube 102 and a magnet bar 104, which is positioned within and extending through the tube 102. The magnet tube 102 is non-magnetic, and the magnet bar 104 may be selectively removable from the tube 102. The illustrated magnet cradle assembly 100 includes three elongated tubes 102 each holding a corresponding magnet bar 104. However, it should be noted that the magnet cradle assembly 100 may include any desired total number (e.g., 1, 2, 3, 4, 5, 6, 7, 8, 9, 10, or more) of tubes 102 each having a magnet bar 104 held therein. The desired number of tubes 102 and magnet bars 104 may be selected based on the dimensions of a fluid path in which the magnet cradle assembly 100 is to be used for swarf removal. In the following description, the terms "tubes 102" and "magnet bars 104" will be used to convey any number of tube(s) and associated magnet bar(s), including as few as one.

The magnet cradle assembly 100 is rotatable between a first position in which the tubes 102 are positioned within a fluid flow path to a second position in which the tubes 102 are positioned out of the fluid flow path and vertically above a discharge location. This rotational function of the magnet cradle assembly 100 will be described in greater detail below with reference, for example, to FIGS. 4 and 5. The rotation of the elongated tubes 102 and associated magnet bars 104 takes place with respect to a rotational axis 106 of the magnet cradle assembly 100.

In addition to the elongated tubes 102 and associated magnet bars 104, the magnet cradle assembly 100 generally includes a shaft 108 (or support bar) extending along the rotational axis 106 of the magnet cradle assembly 100. The magnet cradle assembly 100 also includes at least one bracket 110 having an end 112 fixed to the shaft 108 and extending from the shaft 108 in a radial direction (with respect to axis 106). The elongated tubes 102 are each connected in a fixed relationship to the at least one bracket 110. The illustrated magnet cradle assembly 100 includes two brackets 110A and 110B. However, it should be noted that the magnet cradle assembly 100 may include any desired total number (e.g., 1, 2, 3, 4, 5, 6, or more) of brackets 110, each being connected to the elongated tubes 102 and having an end 112 fixed to the shaft 108. The desired number of brackets 110 may be selected based on the number, length, weight, stiffness, and/or other material properties of the tubes 102 that are used in the magnet cradle assembly 100. In the following description, the term "brackets 110" will be used to convey any number of bracket(s), including as few as one.

The brackets 110 may be plates that are each attached to the shaft 108 and used to offset the tubes 102 in a radial direction (relative to axis 106) from the shaft 108. That way, a mere rotation of the shaft 108 using, for example, a manual crank or automated rotational actuator is able to impart a relatively large change in location of the tubes 102 (i.e., from a swarf collection position to a discharge position). When multiple brackets 110 are used, as illustrated in FIG. 1A, the brackets 110 may be aligned with each other in an axial direction (parallel to axis 106) and extend from the shaft 108 in the same radial direction. As a result, each of the elongated tubes 102 may extend in a direction that is parallel to the rotational axis 106. In other embodiments, the brackets 110 may be skewed with respect to each other about the axis 106 so that the tubes 102 do not extend in a direction that is parallel to the rotational axis 106.

The brackets 110 may be positioned at any desired longitudinal position (with respect to axis 106) along the shaft 108. If the magnet cradle assembly 100 includes only one bracket 110, the bracket 110 may be located at a central point in a longitudinal direction along the shaft 108, or at some other position that reduces or minimizes undesired forces on the tubes 102 during rotation of the magnet cradle assembly 100. In embodiments where the magnet cradle assembly 100 includes multiple brackets 110, the brackets 110 may be spaced equidistant from each other along a length of the shaft 108. When two brackets 110 are used in the magnet cradle assembly 100, the brackets 110 may be located at or proximate the opposing longitudinal ends of the shaft 108 and/or the tubes 102. For example, in FIG. 1A the first bracket 110A is located at a first longitudinal end 114 of the tubes 102 and the second bracket 110B is located at a second longitudinal end 116 (opposite the first end 114) of the tubes 102. In other words, the elongated tubes 102 are each connected to the first bracket 110A at one end and to the second bracket 110B at the other end. This arrangement of the brackets 110 and tubes 102 may provide a maximum stiffness to the assembly (including the tubes 102 and associated magnet bars 104) during rotational movement of the magnet cradle assembly 100 while minimizing a complexity and amount of material used to construct the magnet cradle assembly 100.

The elongated tubes 102 are non-magnetic. To that end, the tubes 102 may be constructed from non-ferrous metal or plastic, or any other desired type of non-magnetic material. As mentioned above, the magnet bars 104 may be selectively removable from the tubes 102. That is, each magnet bar 104 may be longitudinally slid out of its respective tube as illustrated, for example, in FIG. 1B. Having the magnet bars 104 removably enclosed within their respective tubes 102 means that the magnet cradle assembly 100 is able to attract swarf (i.e., ferrous material) to an external surface of the non-magnetic tubes 102 (not touching the magnet bars 104 directly) and then release the swarf at a discharge location upon removal of the magnet bars 104 from the tubes 102.

In some embodiments, the tubes 102 may each be closed at one end (e.g., first longitudinal end 114) and open at an opposite end (e.g., second longitudinal end 116). This may keep the magnet bars 104 physically separated from the fluid flow into which the magnet cradle assembly 100 will be positioned, while still allowing for removal of the magnet bars 104 from the tubes 102. In other embodiments, both ends 114 and 116 of the tubes 102 may be open.

In some embodiments, as described in greater detail below, the magnet bars 104 may include electromagnetic components instead of permanent magnets. The magnet bars 104 may be powered to activate a magnetic field to be in a magnetic collection mode, and later the power may be removed to deactivate the magnetic field and release collected swarf to a discharge location. In such instances, the magnet bars 104 may not be removable from the tubes 102, and the only movement necessary for withdrawal and discharge of the collected swarf is the rotation of the magnet cradle assembly 100 about the axis 106.

In some embodiments, each magnet bar 104 may be equipped with a sealing mechanism located near or at the second (exposed) longitudinal end 116 of the tube 102 while the magnet bar 104 is positioned in the tube 102. This sealing mechanism may act to seal the opening at the second end 116 of each tube 102 such that, when the magnet cradle assembly 100 is rotated to place the tubes 102 in a fluid flow, the magnet bars 104 are maintained physically separated from the swarf-laden fluid. The sealing mechanism may include, for example, a ring made from rubber or similar elastomeric material that can create a fluid tight seal. In other embodiments, however, the magnet bars 104 may not be equipped with such a sealing mechanism. Instead, the tubes 102 may include one or more caps that can be placed over open ends thereof to seal the magnet bars 104 within the tubes 102.

In the magnet cradle assembly 100, the shaft 108 and connected brackets 110, tubes 102, and magnet bars 104 are designed to be rotated about the axis 106 to move the tubes 102 from a swarf collection position to a discharge position. To that end, the magnet cradle assembly 100 may include one or more attachment mechanisms (or mounts) 118 rotatably coupled to the shaft 108 and used to mount the magnet cradle assembly 100 to a structure (e.g., a housing of a swarf removal unit). As the rest of the magnet cradle assembly 100 rotates with respect to the mounts 118 (and the structure), the tubes 102 are rotated between the swarf collection position and the discharge position. In the illustrated embodiment, the magnet cradle assembly includes two mounts 118 for mounting the magnet cradle assembly 100 to a structure. However, in other embodiments just one mount 118 may be used, or more than two mounts may be used. In the following description, the term "mounts 118" will be used to convey any number of mounts(s), including as few as one.

As illustrated, two mounts 118 may be positioned proximate the opposing ends of the shaft 108. The mounts 118 may be positioned longitudinally outward from the brackets 110 along the length of the shaft 108. That way, the mounts 118 and/or the structures to which they are attached do not interfere with movement of the rotating parts of the magnet cradle assembly 100. The mounts 118 may each include a flange portion 120 that is attached directly to a structure (e.g., via bolts, screws, or other fasteners) and a bearing portion 122 that facilitates rotation of the shaft 108 with respect to the flange 120. However, any other desired arrangement of the mount 118 may be utilized to rotatably attach the shaft 108 to a stationary structure.

In some embodiments, rotation of the tubes 102 about the axis 106 of the magnet cradle assembly 100 may be manually operated. The magnet cradle assembly 100 may include a manually operated crank lever 119 used to turn the shaft 108 (and attached brackets 110, tubes 102, and magnet bars 104) about the axis 106. Turning the crank lever 119 causes the shaft 108 to rotate, thereby rotating the tubes 102 about the rotational axis 106 of the shaft 108. This rotation swings the magnet bars 104 held in the tubes 102 from a first position to a second position. The first position may be an operational position located in the path of a fluid flow, while the second position may be a cleaning position located over a discharge location.

Figure 1B:
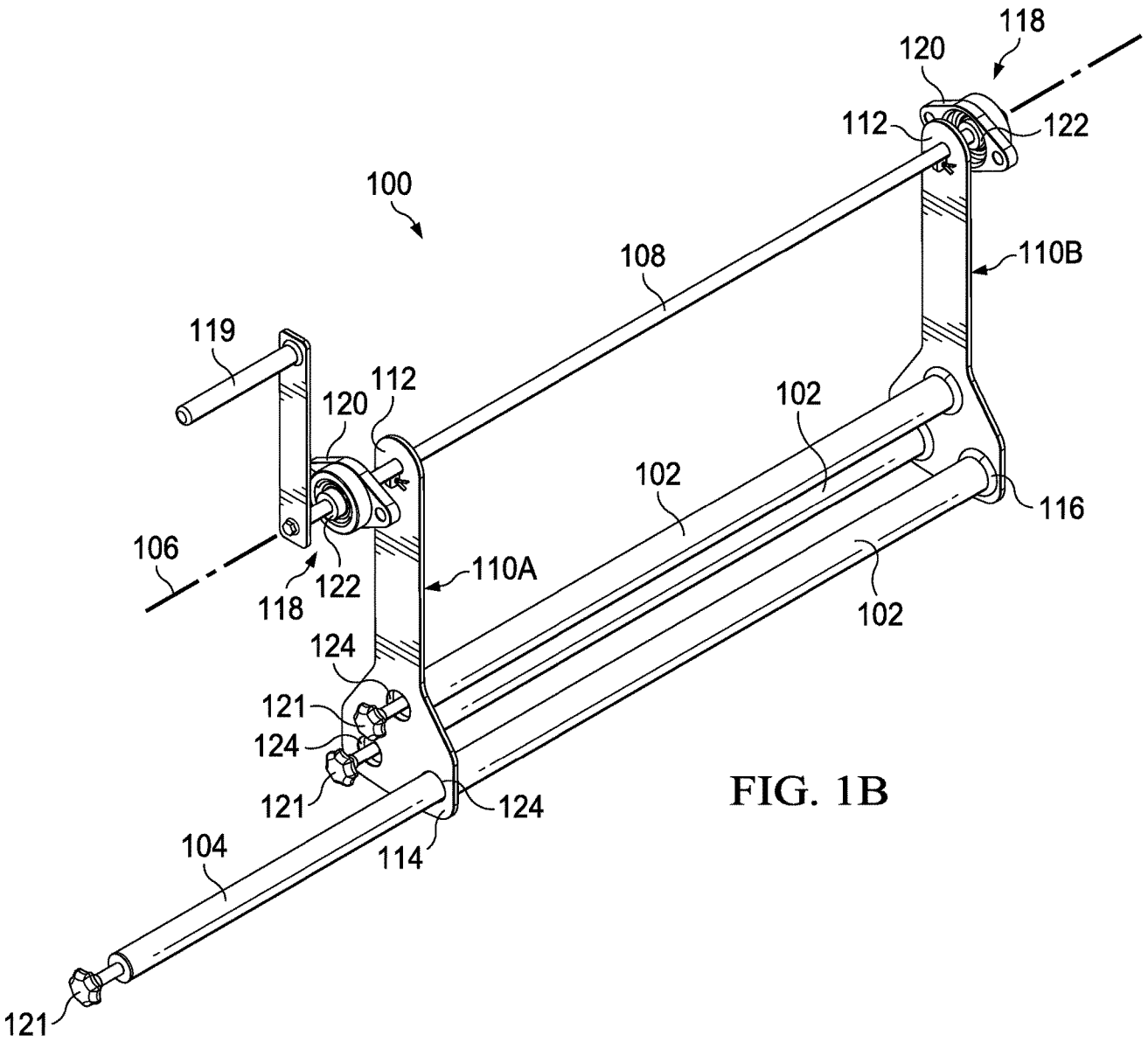

In some embodiments, removal of the magnet bars 104 from the tubes 102 after the tubes 102 are rotated to the cleaning position may be performed manually. To that end, the magnet bars 104 may each feature a pull handle 121 that enables an operator to pull the magnet bars 104 longitudinally out of the tubes 102. The magnet bars 104 may be pulled from their respective tubes 102 using the pull handles 121, as shown in FIG. 1B. As illustrated, each magnet bar 104 may include its own independent pull handle 121. In other embodiments, however, the pull handles 121 of all the magnet bars 104 may be connected together so that pulling a single handle may retrieve all of the magnet bars 104 from their associated tubes 102 at the same time. As illustrated, the pull handles 121 may extend outward from the open ends 116 of the tubes 102 and through apertures 124 in the bracket 110B.

Figure 2:
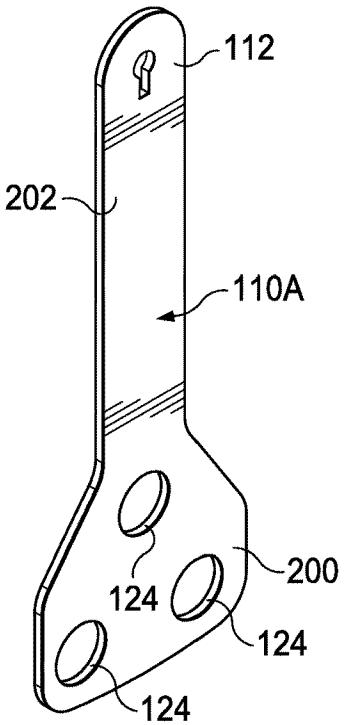
FIG. 2 is an elevation view of a bracket used in the rotatable magnet cradle assembly of FIG. 1, in accordance with an embodiment of the present disclosure.

FIG. 2 illustrates the second bracket 110B in greater detail. The first bracket 110A may have a similar shape, excluding the apertures 124 through which the pull handles of the magnet bars extend. The bracket 110B may include a relatively wide face portion 200 at one end and an elongated portion 202 that is less wide than the face portion 200 extending in one direction from the face portion 200. The distal end 112 of the elongated portion 202 attaches to the shaft of the magnet cradle assembly, and the elongated portion 202 provides an offset of the magnet bars in a radial direction from the shaft.

Figure 3:
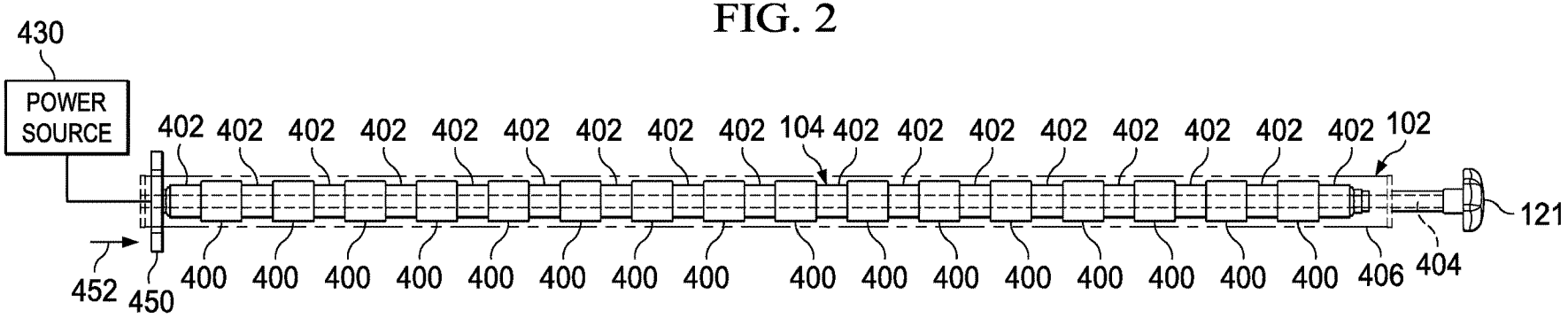
FIG. 3 is a side partial cutaway view of a magnet bar positioned in a tube as used in the rotatable magnet cradle assembly of FIG. 1, in accordance with an embodiment of the present disclosure.

FIG. 3 illustrates one of the magnet bars 104 in its respective tube 102. The magnet bar 104 may include a plurality of magnets 400 separated by spacers 402 (e.g., nylon spacers). These magnets 400 and spacers 402 may be threaded onto or otherwise attached to a rod 404. The rod 404 may extend outside the tube 102 where it is attached to the pull handle 121. Other constructions may be utilized for the magnet bar 104 in other embodiments; this is merely one example of such a magnet bar 104. The magnets 400 may include rare earth magnets, or some other type of magnetic material. The magnet bar 104 may magnetically attract swarf to a radially external surface 406 of the tube 102, where it is held until the magnet bar 104 is removed from the tube 102 (e.g., in response to pulling the handle 121). Once the magnet bar 104 is removed from the tube 102, a magnetic force is no longer acting on the swarf, and the swarf falls from the tube 102 to a discharge location. In other embodiments, the magnets 400 may include electromagnets that are selectively activated to generate a magnetic field via a controllable power source 430. When the power source 430 is connected to and providing power to the electromagnets within the tube 102, a magnetic field is generated to attract the magnetic swarf. When the power source 430 is disconnected or turned off, the electromagnets no longer generate the magnetic field such that the swarf then falls from the tube 102 to a discharge location.

In some embodiments, the magnet cradle assembly may also include one or more external wipers 450 used to help remove swarf from the outside of the tubes 102 upon deactivation of the magnetic field (either by removal of the magnet bar 104 from the tube 102 or removing power to the magnet bar 104). The wiper 450 may be disposed around one or more of the elongated tubes 102 and able to be slid in a longitudinal direction (arrow 452) along the elongated tube 102 to wipe or dislodge any swarf that is sticking to the outside of the tube 102 after the magnetic field is removed. The wiper 450 may be useful in assisting with removal of magnetic swarf, since mud is often sticky, to ensure proper cleaning. Although only one embodiment of the wiper 450 is illustrated in FIG. 3, other embodiments may have different relative shapes, sizes, and configurations surrounding one or more of the tubes 102 within a magnet cradle assembly.

Figure 4:
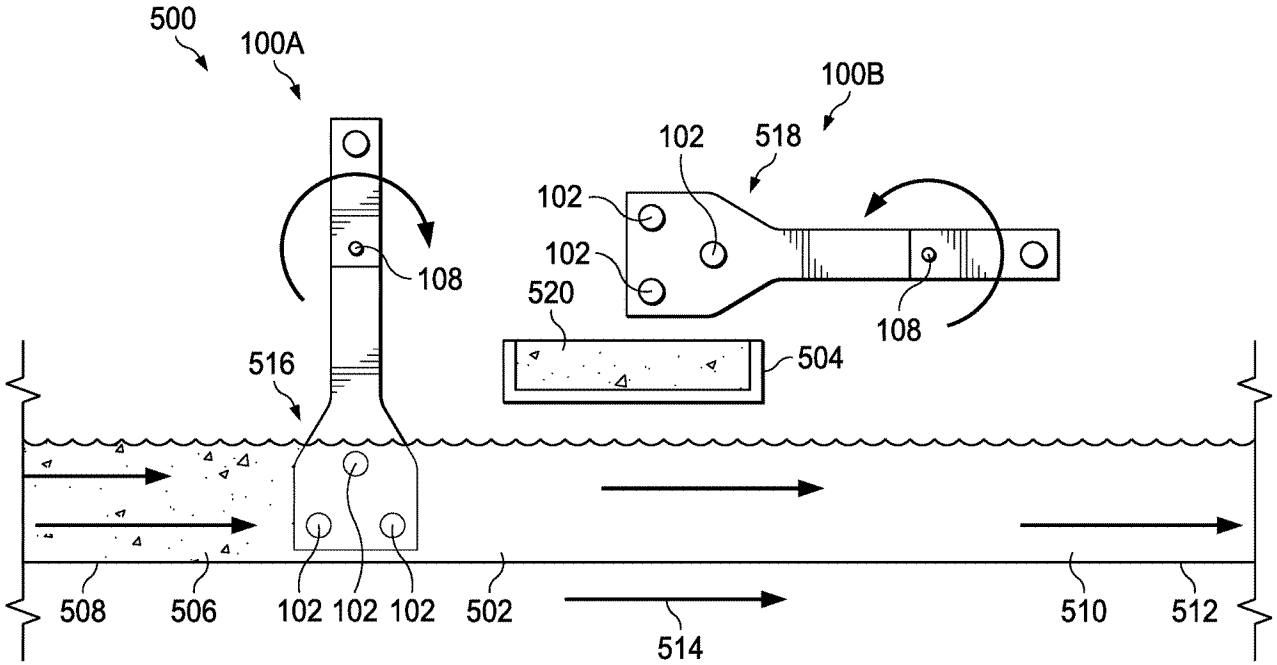
FIG. 4 is a front view of a swarf separator having two rotatable magnet cradle assemblies, in accordance with an embodiment of the present disclosure.

Having described the structure of an individual magnet cradle assembly 100, a more detailed description of the operation of said magnet cradle assembly 100 in the context of a swarf removal unit will now be provided. FIG. 4 illustrates an embodiment of a swarf separator 500 including two magnet cradle assemblies 100. Although two magnet cradle assemblies 100 are shown in the illustrated swarf separator 500, other embodiments may include just one magnet cradle assembly 100, or a greater number (e.g., four or more) of magnet cradle assemblies 100.

In addition to the two magnet cradle assemblies 100, the swarf separator 500 includes a fluid flow path 502 and a discharge chute 504. As illustrated, the fluid flow path 502 may enable fluid to flow beneath the discharge chute 504. The fluid flow path 502 may be a basin-type flow path through which swarf-laden fluid 506 enters on a first side 508 and cleaned fluid 510 exits on a second side 512 opposite the first side 508. The magnet cradle assemblies 100 may be oriented as shown such that the axes 106 of the magnet cradle assemblies are perpendicular to a direction 514 of the fluid flowing through the flow path 502. That way a maximum cross section of the tubes 102 is exposed to the swarf-laden fluid. The magnet cradle assemblies 100 may each extend along the width of the fluid flow path 502.

In FIG. 4, a first magnet cradle assembly 100A is in a first (swarf collection) position 516, while the second magnet cradle assembly 100B is in a second (discharge) position 518. In the swarf collection position 516, the magnet cradle assembly 100A is oriented in a substantially vertical (e.g., within 20 degrees of vertical) direction such that the tubes 102 of the magnet cradle assembly 100A are located in a fluid flow path 502 and exposed to the swarf-laden fluid. From this position, the magnet bars exert an attractive force on the swarf within the fluid so that the swarf is attracted to the outside of the tubes 102 and clean fluid is able to pass through toward the exit. In general, both magnet cradle assemblies 100A and 100B may be positioned in a swarf collection position 516 so that more swarf is removed from the fluid flow.

When the magnet bars (e.g., 104 of FIGS. 1A, 1B, and 3) are located within their respective tubes 102 of a magnet cradle assembly 100 located in the swarf collection position 516, the magnet bars may generate a magnetic field. This magnetic field may radiate outward from the magnet cradle assembly 100 in a three-dimensional array. The magnetic field may extend from the magnet cradle assembly 100 far enough such that there is full coverage of the fluid flow path 502. For example, the magnetic field may extend to provide full coverage of the fluid flow path 502 in both a width direction of the fluid flow path 502 (e.g., parallel to a longitudinal axis of the tubes 102) and in a height direction (from a bottom surface of the fluid flow path 502 to a position above the fluid within the flow path 502). That way, the magnet cradle assembly 100 is able to effectively attract magnetic swarf from all locations within the fluid flow passing through the fluid flow path 502.

When it is desired to clean the swarf off one of the magnet cradle assemblies 100, an operator (or automation equipment) rotates the magnet cradle assembly 100 into the discharge position 518, as shown via the magnet cradle assembly 100B in FIG. 4. In this position 518, the magnet cradle assembly 100B may be oriented in a substantially horizontal (e.g., within 20 degrees of horizontal) direction such that the tubes 102 of the magnet cradle assembly 100B are located vertically above the discharge chute 504. In some embodiments, rotating the magnet cradle assembly 100 from the first (swarf collection) position to the second (discharge) position may be accomplished through a rotation of between 210 and 330 degrees, or alternatively between 240 and 300 degrees, or alternatively 270 degrees. As illustrated the first magnet cradle assembly 100A may rotate in one (clockwise) direction, while the second magnet cradle assembly 100B may rotate in an opposite (counter-clockwise) direction from the swarf collection position 516 to the discharge position 518. Rotation of the magnet cradle assemblies 100 from the fluid flow path 502 to the position above the discharge chute 504 provides a simple and effective way of cleaning swarf removal magnets, compared to existing methods.

Once the magnet cradle assembly 100B is in the discharge position 518, an operator (or automation equipment) may then deactivate the magnetic field from the magnet cradle assembly 100B. This may be accomplished by removing each of the magnet bars 104 from the tubes 102 or by turning off a power source to electromagnets of the magnet bars 104 within the tubes 102, as discussed above. One or more wipers (e.g., 450 of FIG. 3) may be moved across the tubes 102 to further disengage the swarf 520 from the outside of the tubes 102. As a result, the swarf 520 that was previously attached to the tubes 102 is released into the discharge chute 504. The discharge chute 504 may store the collected swarf 520 therein until it can be emptied later, or the discharge chute may route the collected swarf 520 to a final discharge destination nearby. The disclosed magnet cradle assembly 100 enables the removal of swarf from a flow of fluid without an operator having to make contact with either the fluid or the swarf.

As mentioned, a set of two magnet cradle assemblies 100A and 100B may be utilized per discharge chute 504 to ensure that there is always a magnetic barrier maintained in the fluid flow path 502. When one magnet cradle assembly 100B is rotated away from the fluid flow path 502 to the position 518 over the discharge chute 504, the other magnet cradle assembly 100A is maintained in the fluid flow path 502 so that the assembly continually picks up swarf from the fluid flow.

Figure 5:
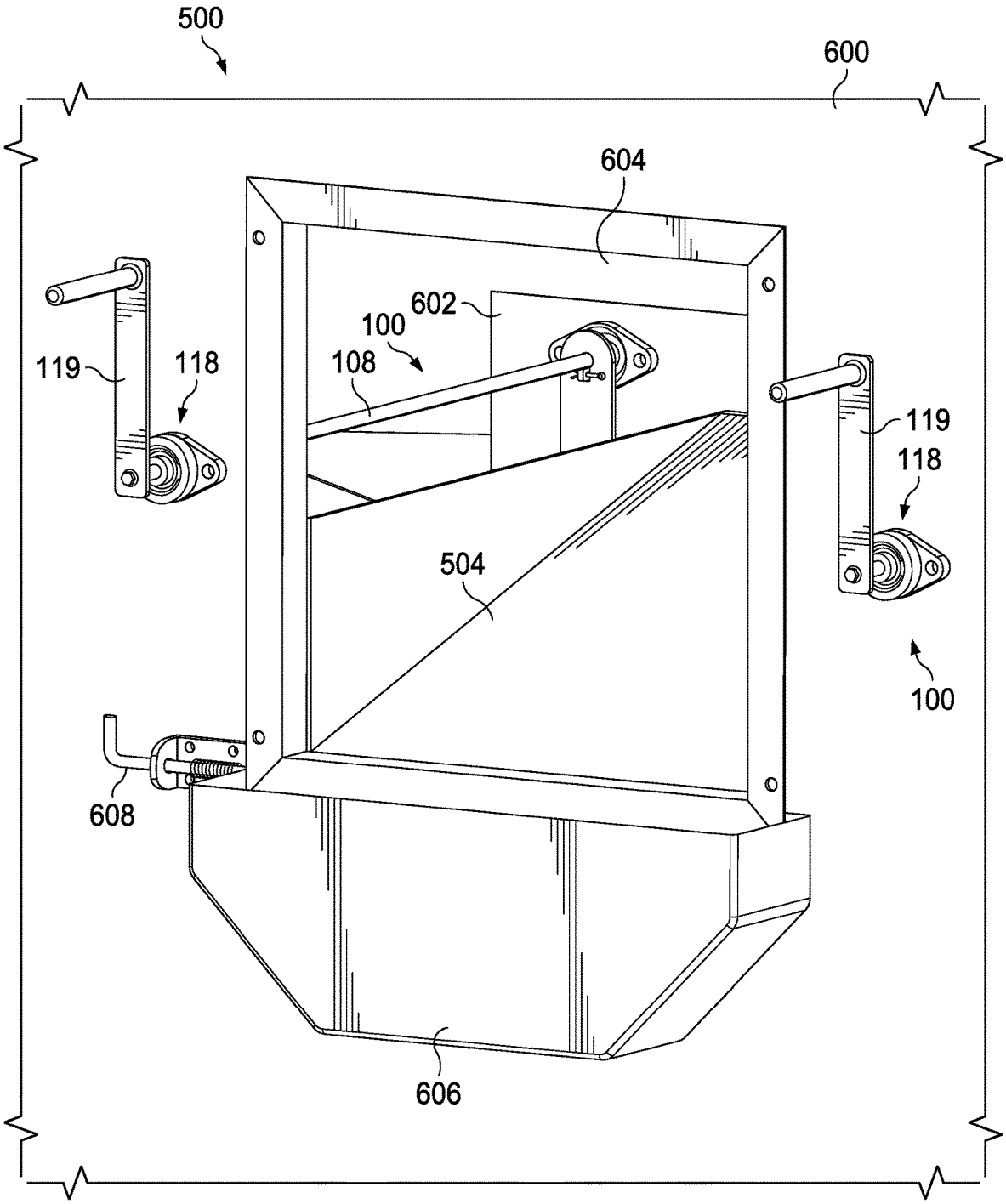
FIG. 5 is an elevation view of a swarf separator having two rotatable magnet cradle assemblies, in accordance with an embodiment of the present disclosure.

FIG. 5 is another illustration of a swarf separator 500 that includes two magnet cradle assemblies 100. As illustrated, the magnet cradle assemblies 100 may each be connected to an external housing 600 of the swarf separator 500 via the respective mounts 118. The magnet cradle assemblies 100 may also be connected to an internal structure 602 within the swarf separator 500 via opposing mounts (not visible). The housing 600 of the swarf separator 500 may include a window 604 formed therein, and the discharge chute 504 may slope in a downward direction from the structure 602 toward the window 604. The window 604 also provides space for pulling the magnet bars out of the tubes of the magnet cradle assemblies 100. As illustrated, both magnet cradle assemblies 100 are in their swarf collection positions with tubes in the fluid flow path that is located in the housing.

As shown, a tray 606 or similar swarf capturing mechanism may be positioned just outside the window 604 so that the collected swarf moves down the discharge chute 504, out the window 604, and into the tray 606. The tray 606 may be selectively removable from the housing 600 (e.g., via a latch 608) so that the captured swarf can be periodically dumped from the tray 606. The swarf separator 500 of FIG. 5 may enable simple and quick removal of swarf from the fluid flow therein using manually operated levers 119, pull handles on the magnet bars, the discharge chute 504, and the removable tray 606, without the operator making any contact with the fluid or swarf.

In some embodiments, one or more of the magnet cradle assemblies 100 described above may be used in a standalone unit (e.g., swarf separator 500) to remove swarf from a fluid flow. In other embodiments, the one or more magnet cradle assemblies 100 may provide swarf removal within the context of a larger swarf removal unit that features other swarf removal components as well. In such cases, the magnet cradles assemblies 100 may provide a secondary or "second pass" removal of swarf from a fluid flow that enters the overall unit.

Figure 6:
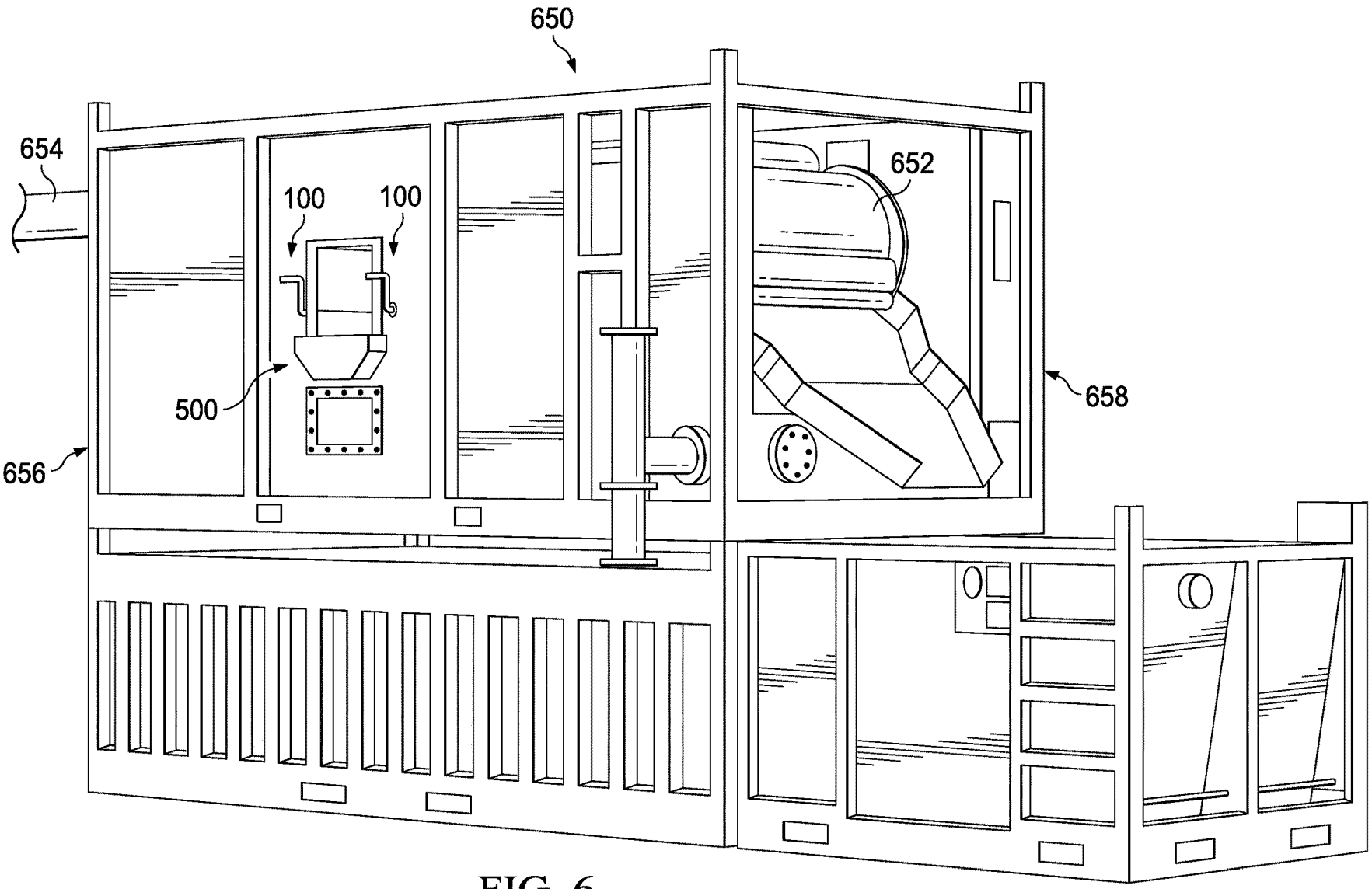
FIG. 6 is an elevation view of a swarf removal unit including a rotatable magnet cradle separator, in accordance with an embodiment of the present disclosure.

FIG. 6 illustrates one such swarf removal unit 650. The swarf removal unit 650 may be disposed at a surface location of a well, where the swarf removal unit 650 may be fluidly coupled to the well to receive one or more fluids as an input. The one or more fluids may include ferrous swarf as a result of milling out of the well. As illustrated, the swarf removal unit 650 may include multiple magnetic swarf removal components, including a magnetic drum separator 652 as well as the disclosed magnet cradle separator 500. The magnetic drum separator 652 may be configured to physically remove the ferrous swarf from the one or more fluids used in a milling operation, or other related operation. The swarf removal unit 650 may include an inlet 654 to a flow path for the one or more fluids towards the magnetic drum separator 652. During operations, one or more fluids may flow from the inlet 654 to the magnetic drum separator 652. As the one or more fluids encounter the magnetic drum separator 652, the magnetic drum separator 652 may remove and displace the ferrous swarf from the one or more fluids. The one or more fluids may subsequently flow below the magnetic drum separator 652 to be further processed, for example, by the magnet cradle separator 500.

The magnet cradle separator 500 may be located downstream of the drum separator 652 within the swarf removal unit 650. The drum separator 652 may remove relatively large pieces of ferrous material from the fluid flow, while the downstream magnet cradle separator 500 using the rotatable magnet cradle assemblies 100 removes relatively smaller or leftover pieces of ferrous material from the fluid flow. A substantially clean fluid then flows out an exit of the swarf removal unit 650 for further processing, storage, or reuse. In other embodiments, the magnet cradle separator 500 may remove a first portion of the swarf from a fluid flow, followed by the drum separator 652 that removes remaining swarf from the fluid flow.

FIG. 6 illustrates a magnet cradle separator 500 on a first side 656 of the swarf removal unit 650. Although not visible in the illustrated view of FIG. 6, the swarf removal unit 650 may include a second magnet cradle separator 500 including another set of magnet cradle assemblies 100 located on a second (opposite) side 658 of the swarf removal unit 650. Together, these two magnet cradle separators 500 may facilitate swarf removal from one or more fluid flow paths through the swarf removal unit 650. It should be noted that the disclosed swarf removal unit 650 may include any desired number of magnet cradle separators 500, which each may include any desired number of magnet cradle assemblies (100 of FIGS. 1-3).

Figure 7A:
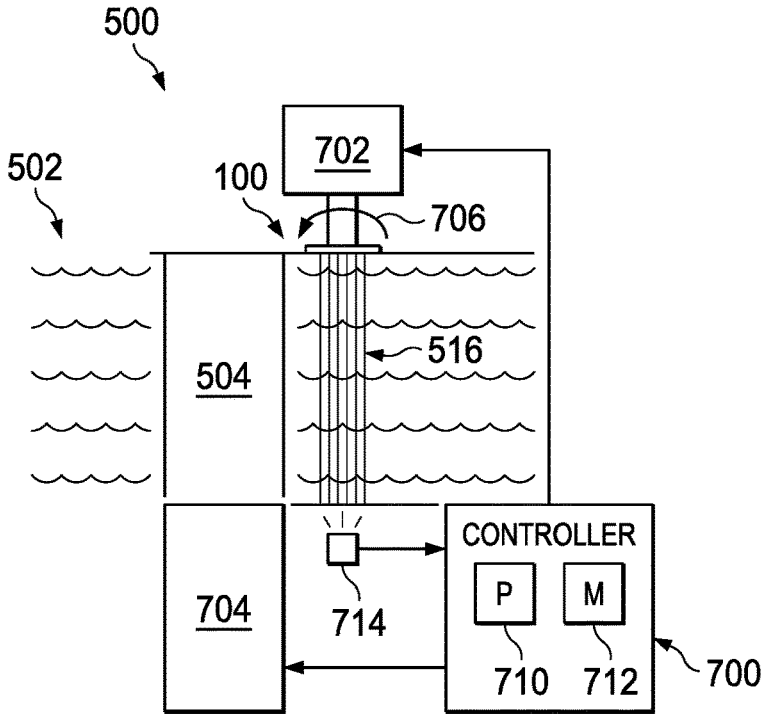
FIGS. 7A and 7B are schematic top views of an automated rotatable magnet cradle assembly, in accordance with an embodiment of the present disclosure.
Figure 7B:
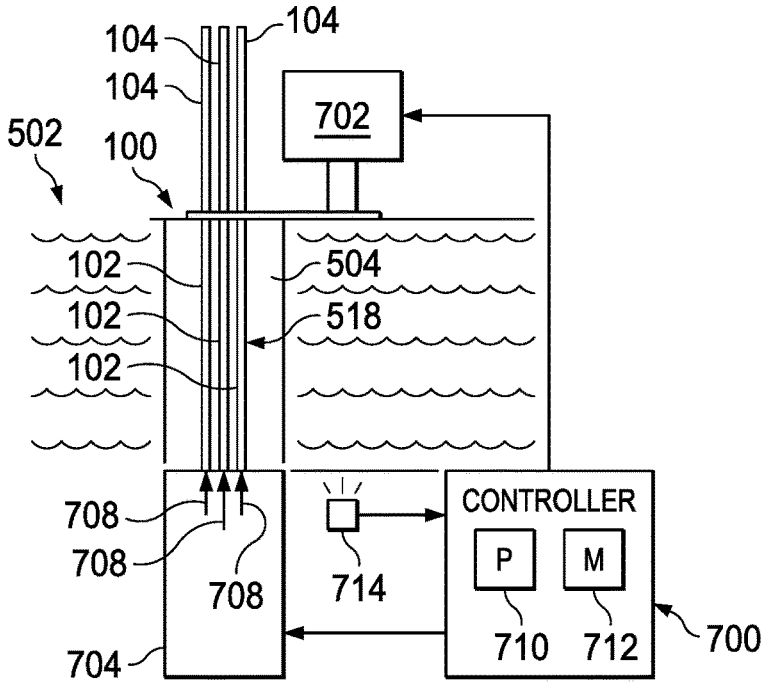
Figure 8:
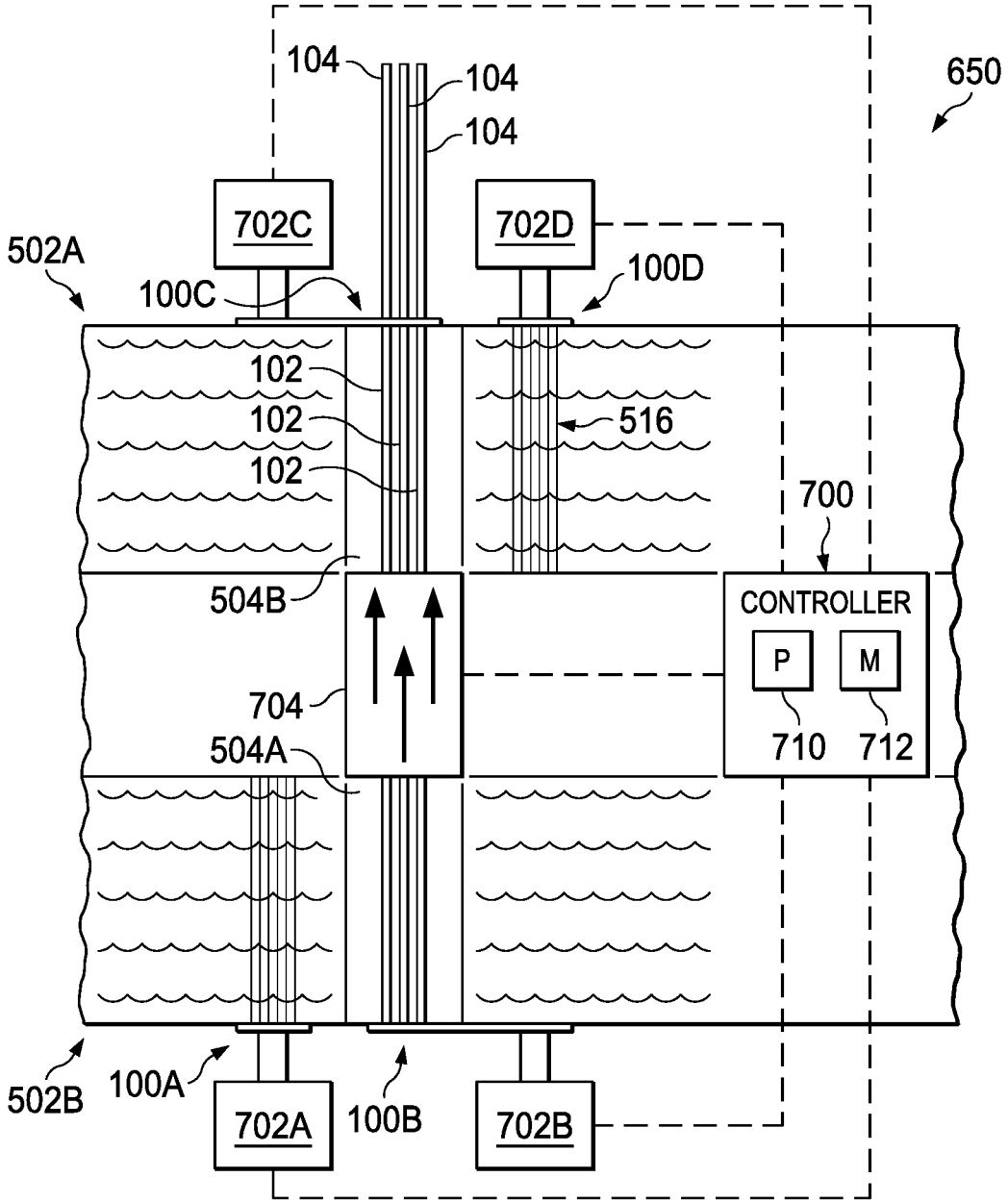
FIG. 8 is a schematic top view of automated rotatable magnet cradle assemblies, in accordance with an embodiment of the present disclosure.

As discussed above, the magnet cradle assemblies 100 may be manually operable to remove swarf from a fluid flow. In other instances, the magnet cradle separator 500 disclosed herein may be automated such that swarf may be removed by the magnet cradle assemblies 100 without any operator intervention whatsoever. FIGS. 7A, 7B, and 8 illustrate embodiments of a magnet cradle separator 500 that is automated and so does not require manual operations.

FIGS. 7A and 7B illustrate an embodiment of a magnet cradle separator 500 having a single magnet cradle assembly 100 that is operated via a controller 700, a rotational actuator 702, and a linear actuator 704. The controller 700 is communicatively coupled to the rotational actuator 702 and the linear actuator 704. The rotational actuator 702 is coupled to the shaft 108 of the magnet cradle assembly 100 and configured to rotate (arrow 706) the shaft 108 between the swarf collection position 516 of FIG. 7A and the discharge position 518 of FIG. 7B in response to a control signal from the controller 700. The rotational actuator 702 may take any desired form that enables reversible rotation by a predetermined amount about an axis such as, for example, an electric motor, a linear actuator coupled to a rack and pinion mechanism, a torsional spring, a gear assembly, and so forth.

The linear actuator 704 may be used to selectively push, pull, or otherwise remove (arrows 708) the magnet bars 104 from their tubes 102 and subsequently return the magnet bars 104 to their tubes 102 in response to one or more control signals from the controller 700. The linear actuator 704 may take any desired form that enables reversible linear movement of the magnet bars 104 including, for example, a spring-loaded actuator, a pneumatic actuator, or a hydraulic actuator. In some embodiments, a second linear actuator (not shown) may be used to move a wiper (e.g., 450 of FIG. 3) along the external surface of one or more of the tubes 102 to remove any residual swarf that was not immediately released upon deactivation of the magnetic field. The second linear actuator may take any desired form that enables reversible linear movement of the wiper including, for example, a spring-loaded actuator, a pneumatic actuator, or a hydraulic actuator.

The controller 700 includes an information handling system having at least one processing component 710 and at least one memory component 712. The memory component 712 may store instructions that are executed on the processing component 710. For instance, the memory component 712 may store instructions that, upon execution by the processing component 710, cause the controller 700 to output control signals to the rotational actuator 702 and the linear actuator 704 for cleaning the magnet cradle assembly 100. In some instances, the controller 700 may output signals to move the magnet cradle assembly 100 from the fluid flow path to the discharge location via the rotational actuator 702, to empty swarf from the magnet cradle assembly 100 into the discharge chute 504 via the linear actuator 704, and to return the magnet cradle assembly 100 to its operating position at regular time intervals. In other embodiments, the controller 700 may be communicatively coupled to one or more sensors 714 used to determine when it is time to clean the magnet cradle assembly 100. The one or more sensors 714 may be photodetectors, cameras, or other visualbased detection systems. The memory component 712 may store instructions that, upon execution by the processing component 710, cause the controller 700 to receive signals from the one or more sensors 714 and determine, based on these signals, when it is time to clean the magnet cradle assembly 100. For example, when the sensor signals indicate that either swarf is still present in the fluid flowing downstream from the magnet cradle assembly 100 or that the magnet cradle assembly 100 is full of collected swarf, the controller 700 may output control signals to the rotational actuator 702 and the linear actuator 704 (and possibly a second linear actuator) to clean the magnet cradle assembly 100.

FIG. 8 illustrates an embodiment of a swarf removal unit 650 including two magnet cradle separators 500 operated via the same controller 700. In FIG. 8, the swarf removal unit 650 may include two fluid flow paths 502 and two discharge chutes 504, one on each side of the unit 650. Each magnet cradle separator 500 may include two magnet cradle assemblies 100, similar to the separators 500 described above with reference to FIGS. 4 and 5. FIG. 8 shows a first magnet cradle assembly 100A located in the operational position 516 within the first fluid flow path 502A, a second magnet cradle assembly 100B located in the discharge position 518 over the first discharge chute 504A, a third magnet cradle assembly 100C located in the discharge position 518 over the second discharge chute 504B, and a fourth magnet cradle assembly 100D located in the operational position 516 in the second fluid flow path 502B.

To provide automated control, the swarf removal unit 650 may include a first rotational actuator 702A coupled to the first magnet cradle assembly 100A, a second rotational actuator 702B coupled to the second magnet cradle assembly 100B, a third rotational actuator 702C coupled to the third magnet cradle assembly 100C, and a fourth rotational actuator 702D coupled to the fourth magnet cradle assembly 100D. Each of the rotational actuators 702 and a single linear actuator 704 may be communicatively coupled to the controller 700. It should be noted that the illustrated controller 700 may be a single controller or a plurality of distributed controllers communicatively coupled to each other.

In the embodiment of FIG. 8, the linear actuator 704 may be dual-acting such that the linear actuator 704 is able to push out the magnet bars 104 of a magnet cradle assembly (e.g., 100C) located over one discharge chute (e.g., 504B) while pulling back in the magnet bars 104 of a magnet cradle assembly (e.g., 100B) located over the opposite discharge chute (e.g., 504A). As discussed at length above, the controller 700 may control operation of all rotational and linear actuators within the swarf removal unit 650 based on, for example, a timed sequence or signals received from one or more sensors.

Figure 9:
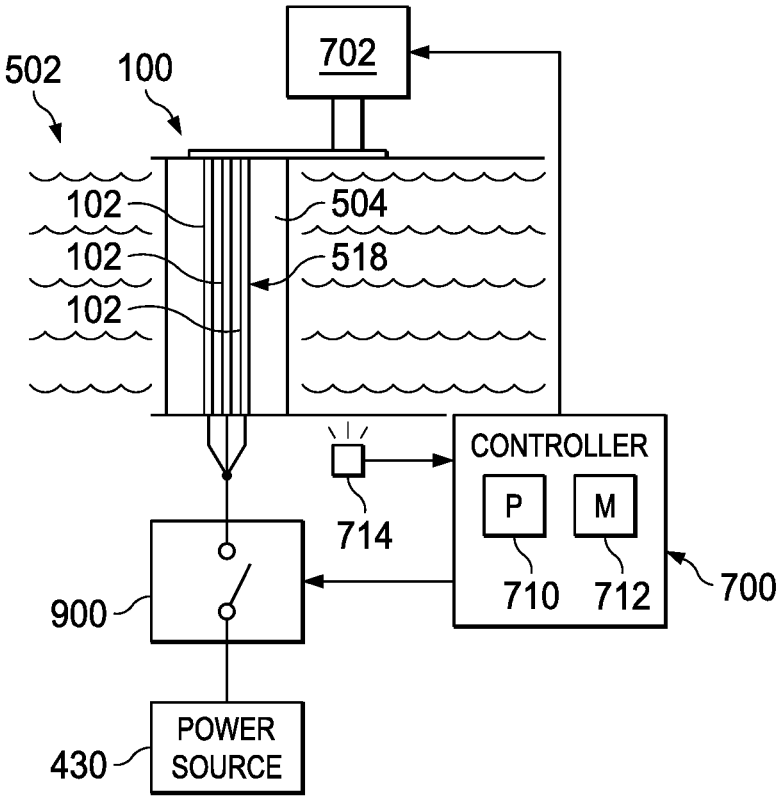
FIG. 9 is a schematic top view of an automated rotatable magnet cradle assembly, in accordance with an embodiment of the present disclosure.

FIG. 9 illustrates an embodiment of a magnet cradle separator 500 having a single magnet cradle assembly 100 that is operated via the controller 700, the rotational actuator 702, and a power source 430 for providing electrical energy to operate the magnet bars within the tubes 102 when the magnet bars are electromagnets. The controller 700 may communicatively coupled to the rotational actuator 702 and to a switch 900 between the power source 430 and the electromagnets in the tubes 102. The rotational actuator 702 is coupled to the shaft 108 of the magnet cradle assembly 100 and configured to rotate (arrow 706) the shaft 108 between the swarf collection position and the discharge position in response to a control signal from the controller 700, as described above with respect to FIGS. 7A and 7B. The rotational actuator 702 may take any desired form that enables reversible rotation by a predetermined amount about an axis such as, for example, an electric motor, a linear actuator coupled to a rack and pinion mechanism, a torsional spring, a gear assembly, and so forth.

Instead of using a linear actuator to remove the magnets from the tubes 102, the controller 700 may output a signal to close the switch 900 between the power source 430 and the magnets while the system is in a swarf collection mode, and the controller 700 may output a signal to open the switch 900 when it is desired to discharge the collected swarf to the discharge location. Removing the power from the electromagnets may automatically deactivate the magnetic field holding the swarf against the outer surface of the tubes 102, as described above, thereby allowing the collected swarf to fall into the discharge location.

In some embodiments, a linear actuator (not shown) may be used to move a wiper (e.g., 450 of FIG. 3) along the external surface of one or more of the tubes 102 to remove any residual swarf that was not immediately released upon deactivation of the magnetic field. The linear actuator may take any desired form that enables reversible linear movement of the wiper including, for example, a spring-loaded actuator, a pneumatic actuator, or a hydraulic actuator.

The controller 700 may control operation of all rotational and linear actuators within the swarf removal unit 650 based on, for example, a timed sequence or signals received from one or more sensors.

Figure 10:
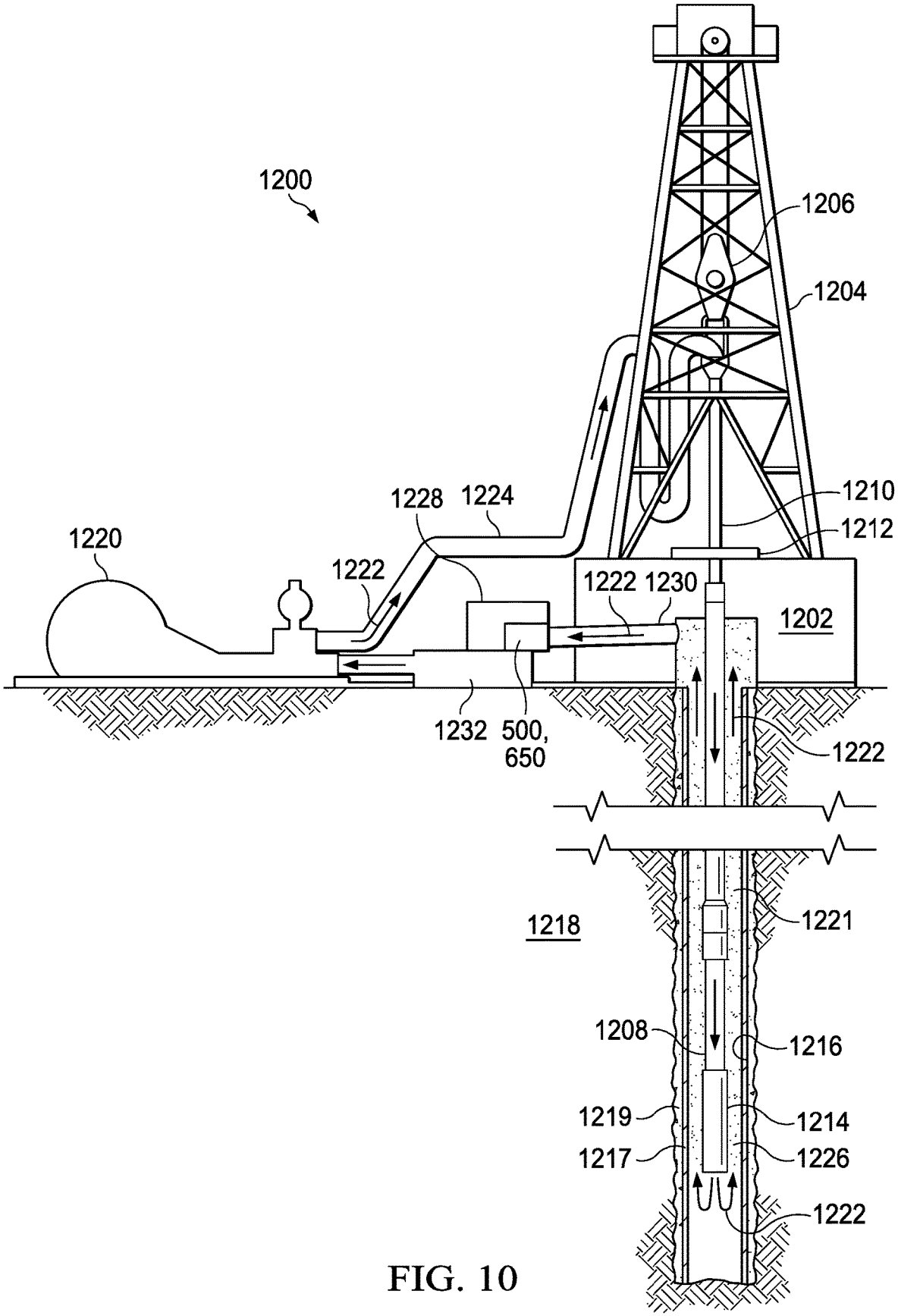
FIG. 10 is a schematic illustration of a well assembly including a swarf removal unit having a rotatable magnet cradle assembly, in accordance with an embodiment of the present disclosure.

The swarf removal systems and methods of the present disclosure may directly or indirectly affect one or more components or pieces of equipment associated with the preparation, delivery, recapture, recycling, reuse, and/or disposal of fluids used in the context of various well system operations, including milling operations. For example, the swarf removal systems and methods may directly or indirectly affect one or more mixers, related mixing equipment, mud pits, storage facilities or units, composition separators, heat exchangers, sensors, gauges, pumps, compressors, and the like used generate, store, monitor, regulate, and/or recondition the fluids from which swarf is removed during milling operations. The swarf removal systems and methods of the present disclosure may also directly or indirectly affect any transport or delivery equipment used to convey the fluid to a well site or downhole such as, for example, any transport vessels, conduits, pipelines, trucks, tubulars, and/or pipes used to compositionally move fluids from one location to another, any pumps, compressors, or motors (e.g., topside or downhole) used to drive the fluids into motion, any valves or related joints used to regulate the pressure or flow rate of the fluids, and any sensors (i.e., pressure and temperature), gauges, and/or combinations thereof, and the like. For example, and with reference to FIG. 10, the disclosed swarf removal systems and methods may directly or indirectly affect one or more components or pieces of equipment associated with an example of a well assembly 1200, according to one or more embodiments. It should be noted that while FIG. 10 generally depicts a land-based assembly, those skilled in the art will readily recognize that the principles described herein are equally applicable to subsea operations that employ floating or sea-based platforms and rigs, without departing from the scope of the disclosure. The principles described herein are also equally applicable to milling operations within water well assemblies, without departing from the scope of the disclosure.

As illustrated, a wellbore 1216 has been drilled through various subterranean formations 1218. A casing string 1217 is at least partially cemented within the wellbore 1216 via cement 1219. The term "casing" is used herein to designate a tubular string used to line a wellbore. The casing may actually be of the type known to those skilled in the art as "liner" and may be a segmented liner or a continuous liner, such as coiled tubing.

The well assembly 1200 may include a platform 1202 that supports a derrick 1204 having a traveling block 1206 for raising and lowering a tubular string 1208. In other embodiments, the tubular string 1208 may be run in from a spool. The tubular string 1208 may include, but is not limited to, pipe or coiled tubing, as generally known to those skilled in the art. A kelly 1210 supports the tubular string 1208 as it is lowered through a rotary table 1212. A milling or cutting tool 1214 is attached to the distal end of the tubular string 1208 and is driven either by a downhole motor and/or via rotation of the tubular string 1208 from the well surface. The cutting tool 1214 is rotated to selectively cut and excise one or more portions of the casing string 1217 and cement 1219 over a predetermined section or length of the wellbore 1216. This milling of the casing string 1217 may be performed about an entire circumference and over a particular length of the wellbore 1216 as part of, for example, a decommissioning operation on the well. In other instances, the milling of the casing string 1217 may be performed in a specific direction with respect to an axis of the wellbore 1216, such as during a slot, section, or window milling operation. Regardless of the extent and purpose of the milling operation, cutting the casing string 1217 may generate a large amount of swarf (or ferrous material) 1221 that is circulated back up through an annulus 1226 of the wellbore 1216.

A pump 1220 (e.g., a mud pump) circulates fluid 1222 through a feed pipe 1224 and to the kelly 1210, which conveys the fluid 1222 downhole through the interior of the tubular string 108 and through one or more orifices in the cutting tool 1214. The fluid 1222 is then circulated back to the surface via the annulus 1226 defined between the tubular string 1208 and the casing string 1217. At the surface, the recirculated or spent fluid 1222 exits the annulus 1226 and may be conveyed to one or more fluid processing unit(s) 1228 via an interconnecting flow line 1230. The fluid processing unit(s) 1228 may include, among other things, one or more magnet cradle separators 500 and/or swarf removal units 650 used to remove the swarf 1221 from the fluid 1222 returned from the well. After passing through the fluid processing unit(s) 1228, a "cleaned" fluid 1222 is deposited into a nearby retention pit 1232 (i.e., a mud pit). While illustrated as being arranged at the outlet of the wellbore 1216 via the annulus 1226, those skilled in the art will readily appreciate that the fluid processing unit(s) 1228, including magnet cradle separator(s) 500 and/or swarf removal unit(s) 650 may be arranged at any other location in the drilling assembly 1200 to facilitate its proper function, without departing from the scope of the disclosure.

As mentioned above, the disclosed swarf removal systems and methods may directly or indirectly affect the components and equipment of the well assembly 1200 by removing swarf from fluid that might otherwise clog or damage these components. For example, the disclosed swarf removal systems and methods may directly or indirectly affect the fluid processing unit(s) 1228 which may include, but is not limited to, one or more of a shaker (e.g., shale shaker), a centrifuge, a hydrocyclone, a separator, a desilter, a desander, a filter (e.g., diatomaceous earth filters), a heat exchanger, any fluid reclamation equipment, and the like. The fluid processing unit(s) 1228 may further include one or more sensors, gauges, pumps, compressors, and the like used to store, monitor, regulate, and/or recondition the fluids that are cleaned via the disclosed swarf removal systems and methods.

The disclosed swarf removal systems and methods may directly or indirectly affect the pump 1220, which representatively includes any conduits, pipelines, trucks, tubulars, and/or pipes used to fluidically convey the cleaned fluids downhole, any pumps, compressors, or motors (e.g., topside or downhole) used to drive the fluids into motion, any valves or related joints used to regulate the pressure or flow rate of the fluids, and any sensors (i.e., pressure, temperature, flow rate, etc.), gauges, and/or combinations thereof, and the like.

The disclosed swarf removal systems and methods may also directly or indirectly affect the various downhole equipment and tools that may come into contact with the fluids that are cleaned via the swarf removal systems and methods such as, but not limited to, the tubular string 1208, any floats, collars, mud motors, downhole motors and/or pumps associated with the tubular string 1208, and any MWD/LWD tools and related telemetry equipment, sensors or distributed sensors associated with the tubular string 1208. The disclosed swarf removal systems and methods may also directly or indirectly affect any downhole heat exchangers, valves and corresponding actuation devices, tool seals, packers and other wellbore isolation devices or components, and the like associated with the wellbore 1216. The disclosed swarf removal systems and methods may also directly or indirectly affect the cutting tool 1214.

While not specifically illustrated herein, the disclosed swarf removal systems and methods may also directly or indirectly affect any transport or delivery equipment used to convey the cleaned fluids such as, for example, any transport vessels, conduits, pipelines, trucks, tubulars, and/or pipes used to fluidically move the fluids from one location to another, any pumps, compressors, or motors used to drive the fluids into motion, any valves or related joints used to regulate the pressure or flow rate of the fluids, and any sensors (i.e., pressure and temperature), gauges, and/or combinations thereof, and the like.

An embodiment of the present disclosure is a magnet cradle assembly including: a shaft extending along a rotational axis; at least one bracket having an end fixed to the shaft and extending from the shaft in a radial direction with respect to the rotational axis; an elongated tube fixed to the at least one bracket; and a magnet bar disposed in the tube.

In one or more embodiments described in the preceding paragraph, the at least one bracket includes a first bracket coupled to the shaft and a second bracket coupled to the shaft, wherein the elongated tube extends between the first and second brackets. In one or more embodiments described in the preceding paragraph, the magnet cradle assembly further includes: a second tube fixed to the at least one bracket; a second magnet bar disposed in the second tube; a third tube fixed to the at least one bracket; and a third magnet bar disposed in the third tube, wherein the third magnet bar is selectively removable from the third tube. In one or more embodiments described in the preceding paragraph, the magnet bar is selectively removable from the tube. In one or more embodiments described in the preceding paragraph, the magnet cradle assembly further includes a pull handle coupled to an end of the magnet bar to facilitate pulling of the magnet bar out of the tube. In one or more embodiments described in the preceding paragraph, the magnet cradle assembly further includes an attachment mechanism for rotatably coupling the shaft to a structure; and a crank lever extending from the shaft to facilitate manual rotation of the magnet cradle assembly with respect to the structure. In one or more embodiments described in the preceding paragraph, the magnet cradle assembly further includes a power source coupled to the magnet bar, wherein the magnet bar includes an electromagnet that selectively outputs a magnetic field in response to power from the power source. In one or more embodiments described in the preceding paragraph, the magnet cradle assembly further includes an external wiper disposed around the tube.

Another embodiment of the present disclosure is a swarf removal system including: a housing; a fluid flow path at least partially located in the housing; a discharge chute located proximate the fluid flow path; and a magnet cradle assembly rotatably coupled to the housing. The magnet cradle assembly includes an elongated tube and a magnet bar disposed in the tube. The magnet cradle assembly is rotatable with respect to the housing from a first position in which the tube is positioned within the fluid flow path to a second position in which the tube is positioned out of the fluid flow path and vertically above the discharge chute.

In one or more embodiments described in the preceding paragraph, the magnet cradle assembly further includes: a shaft extending along a rotational axis of the magnet cradle assembly; and at least one bracket extending from the shaft in a radial direction with respect to the axis, wherein the tube is fixed to the at least one bracket. In one or more embodiments described in the preceding paragraph, the elongated tube extends along a width of the fluid flow path. In one or more embodiments described in the preceding paragraph, the swarf removal system further includes a second magnet cradle assembly rotatably coupled to the housing, wherein the second magnet cradle assembly is located on an opposite side of the discharge chute from the magnet cradle assembly. In one or more embodiments described in the preceding paragraph, the magnet cradle assembly further includes a crank lever extending from the shaft to facilitate manual rotation of the magnet cradle assembly with respect to the housing. In one or more embodiments described in the preceding paragraph, the swarf removal system further includes a tray removably coupled to an exterior surface of the housing at an edge of the discharge chute. In one or more embodiments described in the preceding paragraph, the swarf removal system further includes a controller; and a rotational actuator communicatively coupled to the controller, wherein the rotational actuator rotates the magnet cradle assembly between the first and second positions in response to control signals from the controller.

Another embodiment of the present disclosure is a method including positioning a magnet cradle assembly at least partially within a fluid flow. The magnet cradle assembly includes a shaft extending along a rotational axis; at least one bracket extending from the shaft in a radial direction with respect to the axis; an elongated tube fixed to the at least one bracket; and a magnet bar disposed in the tube. The magnet bar is selectively removable from the tube. The method further includes attracting swarf from within the fluid flow to an external surface of the tube via a magnetic field from the magnet bar, and allowing the magnet cradle assembly to be rotated about the axis such that the tube and the attracted swarf is moved out of the fluid flow and to a position vertically above a discharge chute.

In one or more embodiments described in the preceding paragraph, the method further includes allowing the magnet bar to be removed from the tube to release the swarf into the discharge chute. In one or more embodiments described in the preceding paragraph, the method further includes allowing the magnet cradle assembly to be manually rotated via a crank lever extending from the shaft. In one or more embodiments described in the preceding paragraph, the method further includes rotating the magnet cradle assembly about the axis via a rotational actuator to the position vertically above the discharge chute. In one or more embodiments described in the preceding paragraph, the method further includes positioning a second magnet cradle assembly at least partially within the fluid flow, and maintaining the second magnet cradle assembly at least partially within the fluid flow while the magnet cradle assembly is rotated about the axis to the position vertically above the discharge chute.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A magnet cradle assembly, comprising:

a shaft extending along a rotational axis;

at least one bracket having an end fixed to the shaft and extending from the shaft in a radial direction with respect to the rotational axis;

an elongated first tube fixed to the at least one bracket and located a first distance away from the shaft in a radial direction with respect to the rotational axis;

a first magnet bar disposed in the first tube;

an elongated second tube fixed to the at least one bracket and located a second distance away from the shaft in a radial direction with respect to the rotational axis, the second distance being different than the first distance; and a second magnet bar disposed in the second tube.

2. The magnet cradle assembly of claim 1, wherein the at least one bracket comprises a first bracket coupled to the shaft and a second bracket coupled to the shaft, wherein the first and second elongated tubes each extend between the first and second brackets.

3. The magnet cradle assembly of claim 1, further comprising:

a third tube fixed to the at least one bracket; and a third magnet bar disposed in the third tube.

4. The magnet cradle assembly of claim 1, wherein the first magnet bar is selectively removable from the first tube.

5. The magnet cradle assembly of claim 4, further comprising a pull handle coupled to an end of the first magnet bar to facilitate pulling of the first magnet bar out of the first tube.

6. The magnet cradle assembly of claim 1, further comprising:

an attachment mechanism for rotatably coupling the shaft to a structure; and a crank lever extending from the shaft to facilitate manual rotation of the magnet cradle assembly with respect to the structure.

7. The magnet cradle assembly of claim 1, further comprising:

a power source coupled to the first magnet bar, wherein the first magnet bar comprises an electromagnet that selectively outputs a magnetic field in response to power from the power source.

8. The magnet cradle assembly of claim 1, further comprising an external wiper disposed around the first tube.

9. A swarf removal system, comprising:

a housing;

a fluid flow path at least partially located in the housing;

a discharge chute located proximate the fluid flow path;

a first magnet cradle assembly rotatably coupled to the housing, the first magnet cradle assembly comprising an elongated first tube and a magnet bar disposed in the first tube;

wherein the first magnet cradle assembly is rotatable with respect to the housing from a position in which the first tube is positioned within the fluid flow path to a position in which the first tube is positioned out of the fluid flow path and vertically above the discharge chute; and a second magnet cradle assembly rotatably coupled to the housing, the second magnet cradle assembly comprising an elongated second tube and a magnet bar disposed in the second tube;

wherein the second magnet cradle assembly is rotatable with respect to the housing independent of the first magnet cradle assembly from a position in which the second tube is positioned within the fluid flow path to a position in which the second tube is positioned out of the fluid flow path and vertically above the discharge chute.

10. The swarf removal system of claim 9, wherein the first magnet cradle assembly further comprises:

a first shaft extending along a rotational axis of the first magnet cradle assembly; and at least one bracket extending from the shaft in a radial direction with respect to the axis, wherein the first tube is fixed to the at least one bracket.

11. The swarf removal system of claim 9, wherein the elongated first tube extends along a width of the fluid flow path.

12. The swarf removal system of claim 9, wherein the second magnet cradle assembly is located on an opposite side of the discharge chute from the first magnet cradle assembly.

13. The swarf removal system of claim 9, wherein:

the first magnet cradle assembly further comprises a first crank lever to facilitate manual rotation of the first magnet cradle assembly with respect to the housing; and the second magnet cradle assembly further comprises a second crank lever separate from the first crank lever to facilitate manual rotation of the second magnet cradle with respect to the housing.

14. The swarf removal system of claim 9, further comprising a tray removably coupled to an exterior surface of the housing at an edge of the discharge chute.

15. The swarf removal system of claim 9, further comprising:

a controller;

a first rotational actuator communicatively coupled to the controller, wherein the first rotational actuator rotates the first magnet cradle assembly in response to control signals from the controller; and a second rotational actuator communicatively coupled to the controller, wherein the second rotational actuator rotates the second magnet cradle assembly in response to control signals from the controller.

16. A method, comprising:

positioning a magnet cradle assembly at least partially within a fluid flow, the magnet cradle assembly comprising:

a shaft extending along a rotational axis;

at least one bracket extending from the shaft in a radial direction with respect to the axis;

an elongated tube fixed to the at least one bracket; and a magnet bar disposed in the tube, wherein the magnet bar is selectively removable from the tube;

attracting swarf from within the fluid flow to an external surface of the tube via a magnetic field from the magnet bar;

allowing the magnet cradle assembly to be rotated about the axis in a first direction from a first rotational stop position about the axis to a second rotational stop position about the axis such that the tube and the attracted swarf is moved out of the fluid flow and to a position vertically above a discharge chute; and allowing the magnet cradle assembly to be rotated in a second direction about the axis opposite the first direction from the second rotational stop position back to the first rotational stop position.

17. The method of claim 16, further comprising allowing the magnet bar to be removed from the tube to release the swarf into the discharge chute.

18. The method of claim 16, further comprising allowing the magnet cradle assembly to be manually rotated via a crank lever extending from the shaft.

19. The method of claim 16, further comprising rotating the magnet cradle assembly about the axis via a rotational actuator to the position vertically above the discharge chute.

20. The method of claim 16, further comprising:

positioning a second magnet cradle assembly at least partially within the fluid flow; and maintaining the second magnet cradle assembly at least partially within the fluid flow while the magnet cradle assembly is rotated about the axis to the position vertically above the discharge chute;

wherein the second magnet cradle assembly is rotatable about a second rotational axis separated from the rotational axis.

* * * * *